US012320111B2

(12) United States Patent
Lin et al.

(10) Patent No.: US 12,320,111 B2
(45) Date of Patent: Jun. 3, 2025

(54) WATER PATH SELF-DETECTION METHOD FOR CLEANING DEVICE AND CONTROL DEVICE THEREFOR

(71) Applicant: Komoo Intelligent Technology Co., Ltd., Fujian (CN)

(72) Inventors: Xiaofa Lin, Fujian (CN); Xiaoshan Lin, Fujian (CN); Zuhua Liu, Fujian (CN); Shan Lin, Fujian (CN); Yongshou Huang, Fujian (CN)

(73) Assignee: Komoo Intelligent Technology Co., Ltd., Xiamen (CN)

( * ) Notice: Subject to any disclaimer, the term of this patent is extended or adjusted under 35 U.S.C. 154(b) by 226 days.

(21) Appl. No.: 18/088,117

(22) Filed: Dec. 23, 2022

(65) Prior Publication Data

US 2023/0128459 A1 Apr. 27, 2023

Related U.S. Application Data

(63) Continuation of application No. PCT/CN2021/096414, filed on May 27, 2021.

(30) Foreign Application Priority Data

Jun. 28, 2020 (CN) ..... 202010598864.3

(51) Int. Cl.
*E03D 9/08* (2006.01)

(52) U.S. Cl.
CPC ..... *E03D 9/08* (2013.01)

(58) Field of Classification Search
CPC ..... E03D 9/08
(Continued)

(56) References Cited

U.S. PATENT DOCUMENTS 6,105,178 A * 8/2000 Kurisaki ..... E03D 9/08 4/444
6,327,718 B1 * 12/2001 Ono ..... E03D 9/08 4/420.2

(Continued)

FOREIGN PATENT DOCUMENTS

CN 203546850 U 4/2014
CN 105588180 A 5/2016

(Continued)

OTHER PUBLICATIONS

International Search Report and English Translation cited in PCT/CN2021/096414, mailed Aug. 11, 2021, 7 pages.

(Continued)

*Primary Examiner* — Huyen D Le
(74) *Attorney, Agent, or Firm* — Cooper Legal Group, LLC

(57) ABSTRACT

After a cleaning device is powered-on and initialized, a water path self-detection method for the cleaning device comprises the following steps: 1) judging whether a low water level switch is turned on; if so, controlling a water inlet valve to be turned on, controlling a water pump to be turned off, and going to step 2; if not, controlling the water pump to be turned on, controlling the water inlet valve to be turned off, and going to step 3; 2) judging whether a water replenishment time exceeds a preset first threshold; if so, a fault is confirmed, and the water inlet valve is controlled to be turned off; and if not, returning to step 1; 3) judging whether the low water level switch is turned on; and 4) judging whether a water pumping time exceeds a preset second threshold.

10 Claims, 5 Drawing Sheets

(58) Field of Classification Search
USPC ..... 4/420.4
See application file for complete search history.

(56) References Cited

U.S. PATENT DOCUMENTS

| | | | | |
|---|---|---|---|---|
| 6,754,912 | B1 * | 6/2004 | Hayashi | E03D 9/08 239/468 |
| 8,272,077 | B2 * | 9/2012 | Hashimoto | E03D 9/08 4/443 |
| 8,701,222 | B2 * | 4/2014 | Shin | E03D 9/08 4/443 |
| 2010/0125941 | A1 * | 5/2010 | Shin | E03D 9/08 4/443 |
| 2013/0180041 | A1 | 7/2013 | Ding et al. | |

FOREIGN PATENT DOCUMENTS

| | | | |
|---|---|---|---|
| CN | 206378751 | U | 8/2017 |
| CN | 108954849 | A | 12/2018 |
| CN | 110326961 | A | 10/2019 |
| CN | 110726250 | A | 1/2020 |
| CN | 111166266 | A | 5/2020 |
| CN | 111272403 | A | 6/2020 |
| CN | 111896282 | A | 11/2020 |
| ES | 2566452 | A | 4/2016 |
| JP | 2010285774 | A | 12/2010 |
| JP | 2016216953 | A | 12/2016 |
| JP | 2019158270 | A | 9/2019 |
| JP | 2019199780 | A | 11/2019 |
| TW | 201418690 | A | 5/2014 |
| TW | 201534788 | A | 9/2015 |
| WO | 2014006791 | A1 | 1/2014 |

OTHER PUBLICATIONS

Decision to Grant cited in JP2022-573391, mailed Dec. 19, 2023, 5 pages.

* cited by examiner

WATER PATH SELF-DETECTION METHOD FOR CLEANING DEVICE AND CONTROL DEVICE THEREFOR

RELATED APPLICATIONS

This application is a continuation of and claims priority to International patent application number PCT/CN2021/096414, filed on May 27, 2021, which claims priority to Chinese patent application number 202010598864.3, filed on Jun. 28, 2020. International patent application number PCT/CN2021/096414 and Chinese patent application number 202010598864.3 are incorporated herein by reference.

FIELD OF THE DISCLOSURE

The present disclosure relates to a cleaning device in the field of sanitary ware, in particular to a water path self-detection method and a control device.

BACKGROUND OF THE DISCLOSURE

Existing sanitary cleaning devices usually comprise a water tank, a solenoid valve, a temperature sensor or a flow sensor, a heater, a water pump, a nozzle, a controller, and other components. The water tank is used to store cleaning water, the water pump is used to extract the cleaning water, and the heater is used to heat the extracted cleaning water and then send the cleaning water to a spray washing device for butt washing and/or women's washing. The temperature sensor is used to detect a temperature, the flow sensor is used to detect a flow rate, and the controller is used to control coordinated work of each component to achieve the washing function.

When existing sanitary cleaning devices are powered on for the first time, a self-detection process is required to be performed to detect whether water path components of the water tank can work normally. Usually, whether water path components of the water tank can work normally is only judged by testing equipment, current signals, or data collection during one-way use. The complexity and accuracy considered are not ideal, and the ability to judge whether water path components of the water tank can work normally is easily limited by conditions of the use environment and detection interference. For example, when the existing sanitary cleaning devices are powered on for the first time, the solenoid valve is turned on, a signal of a flow meter is used to judge whether a flow rate is abnormal, only whether there is water or not and a flow size can be detected, and which part of the water path is abnormal cannot be judged. For example, a fault of the flow meter, a fault of pipelines, a fault of the water solenoid valve, etc. cannot be distinguished and judged.

BRIEF SUMMARY OF THE DISCLOSURE

The present disclosure provides a water path self-detection method and a control device to solve the deficiencies in the background, which fully considers various abnormal conditions, and the judgment method is simple and reliable.

A technical solution of the present disclosure is as follows.

A water path self-detection method for a cleaning device is provided. The cleaning device comprises a water tank, a low water level switch, a high water level switch, a water inlet valve, an instant heater box, and a water pump. The low water level switch and the high water level switch are disposed in the water tank, the water inlet valve is in communication with the water tank, and the water pump is connected between the water tank and the instant heater box. After the cleaning device is powered-on and initialized, the water path self-detection method comprises the following self-detection steps:

1) judging whether the low water level switch is turned on; when the low water level switch is turned on, controlling the water inlet valve to be turned on, controlling the water pump to be turned off, and going to step 2; and when the low water level switch is turned off, controlling the water pump to be turned on, controlling the water inlet valve to be turned off, and going to step 3;
2) judging whether a water replenishment time exceeds a preset first threshold; when the water replenishment time exceeds the preset first threshold, a water shortage fault is confirmed, and the water inlet valve is controlled to be turned off; and when the water replenishment time does not exceed the preset first threshold, returning to step 1;
3) judging whether the low water level switch is turned on; when the low water level switch is turned on, a water path is normal, and the water pump is controlled to be turned off; and when the low water level switch is turned off, going to step 4; and
4) judging whether a water pumping time exceeds a preset second threshold; when the water pumping time exceeds the preset second threshold, a water pump fault or an instant heater box water shortage fault is confirmed, and the water pump is controlled to be turned off; and when the water pumping time does not exceed the preset second threshold, returning to step 3.

Preferably, the water path self-detection method for the cleaning device comprises, after the self-detection steps are complete, judging whether the water path is normal when it is detected that a toilet seat is seated; when the water path is normal, going back to step 1; and when the water path is abnormal, performing a fault removing step.

Preferably, the fault removing step comprises performing water replenishment of the water tank first and then performing water replenishment of the instant heater box.

Preferably, the water replenishment of the water tank comprises water replenishment in a non-flushing mode, and the water replenishment in the non-flushing mode comprises: controlling the water inlet valve to be turned on for water replenishing when the low water level switch is turned on, and controlling the water inlet valve to be turned off for stopping the water replenishing when the low water level switch is turned off.

Preferably, the water replenishment in the non-flushing mode comprises, when a water inlet time exceeds the preset first threshold and the low water level switch is still turned on, controlling the water inlet valve to be turned off for stopping the water replenishing, and reporting the water shortage fault.

Preferably, the water replenishment of the water tank comprises water replenishment in a flushing mode, and the water replenishment in the flushing mode comprises: controlling the water inlet valve to be turned on for water replenishing when the low water level switch is turned on, and controlling the water inlet valve to be turned off for stopping the water replenishing when the high water level switch is turned on.

Preferably, the water replenishment in the flushing mode comprises: when a water inlet time exceeds a preset third threshold and the low water level switch is still turned on:

controlling the water inlet valve to be turned off for stopping the water replenishing, and reporting the water shortage fault.

Preferably, the water path self-detection method for the cleaning device comprises, when the water pump is turned on in the water replenishment of the instant heater box and in step 1, controlling the water pump to perform water pumping at a same duty cycle.

Preferably, the water path self-detection method for the cleaning device comprises judging whether the low water level switch and the high water level switch are turned off at the same time; when the low water level switch and the high water level switch are turned off at the same time, a water level switch fault is confirmed.

A control device for the water path self-detection method for the cleaning device comprises a controller configured to perform the water path self-detection method.

Compared with the existing techniques, the technical solution has the following advantages.

1. In the method and the device of the present disclosure, when the cleaning device is powered-on and initialized, a state of the water inlet valve and a state the water pump are controlled to be combined with the low water level switch to judge whether there is a water path fault, so as to avoid component damage. The judgment method is simple and reliable, no additional testing equipment and modules are required, and the cost is low.

2. In the method and the device of the present disclosure, after the self-detection steps are completed, when the toilet seat is seated, one of the fault removing step or the self-detection steps is selected according to whether the water path is faulty or not, so as to further detect whether the fault is removed or whether the water path is normal.

3. In the method and device of the present disclosure, the fault removing step comprises water replenishment of the water tank and water replenishment of the instant heater box. The replenishment of the water tank comprises water replenishment in non-flushing mode or water replenishment in flushing mode. According to the water inlet time in different situations, the water path fault can be further judged.

4. In the method and device of the present disclosure, when the cleaning device is powered-on and initialized and the instant heat box is replenished with water, \the water pump is controlled to pump water according to the same duty cycle, so as to avoid instantaneous overshoot of temperature due to flow changes.

5. The method and device of the present disclosure can also judge whether a water level switch fault occurs by detecting whether the low water level switch and the high water level switch are turned off at the same time.

BRIEF DESCRIPTION OF THE DRAWINGS

FIG. 1 illustrates a cross-sectional view of a water tank in the present disclosure, illustrating an inside structure of the water tank when a low water level switch is turned on.

FIG. 2 illustrates a cross-sectional view of the water tank in the present disclosure, illustrating the inside structure of the water tank when a high water level switch is turned on.

DETAILED DESCRIPTION OF THE EMBODIMENTS

Figure 1:
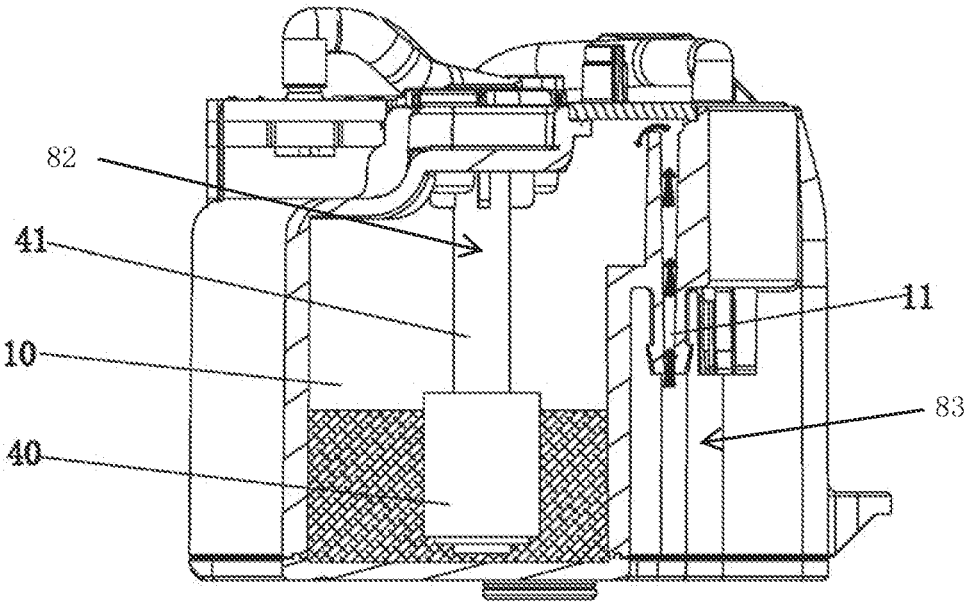
Figure 2:
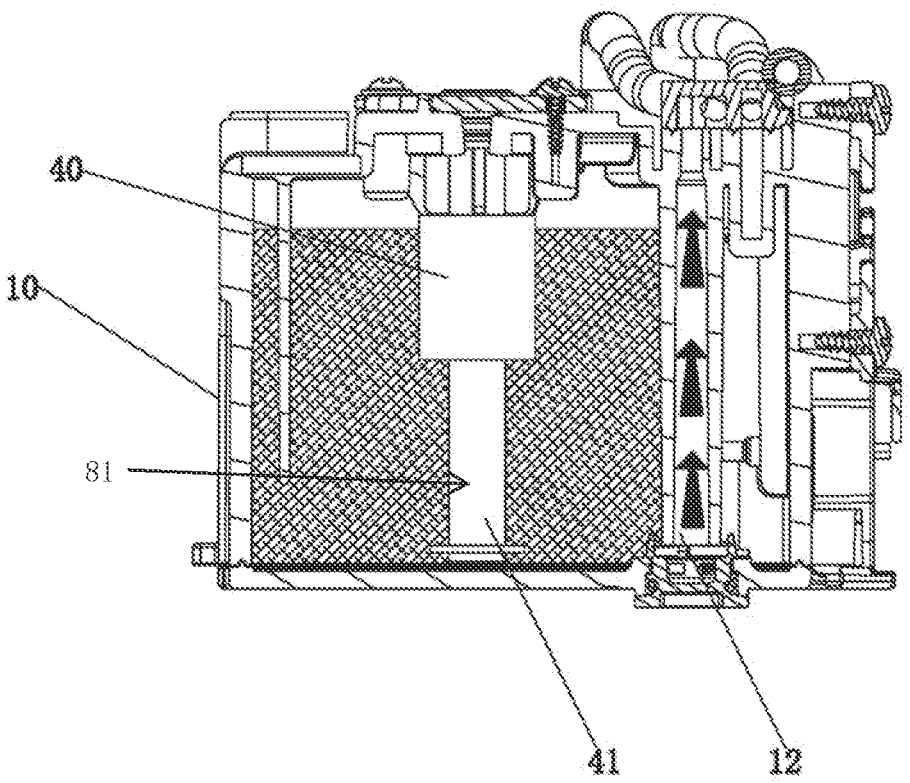
Figure 3:
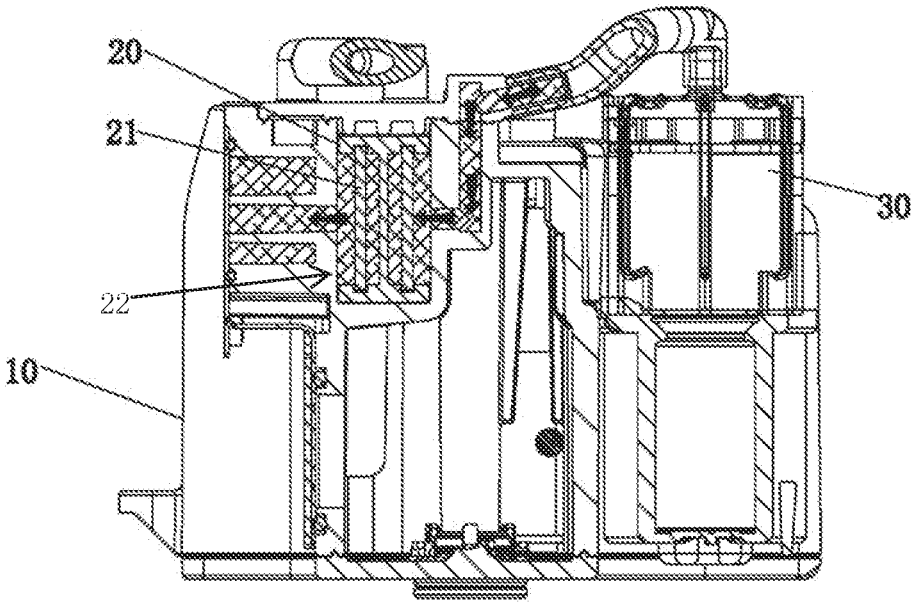
FIG. 3 illustrates a cross-sectional view of the water tank in the present disclosure.
Figure 4:
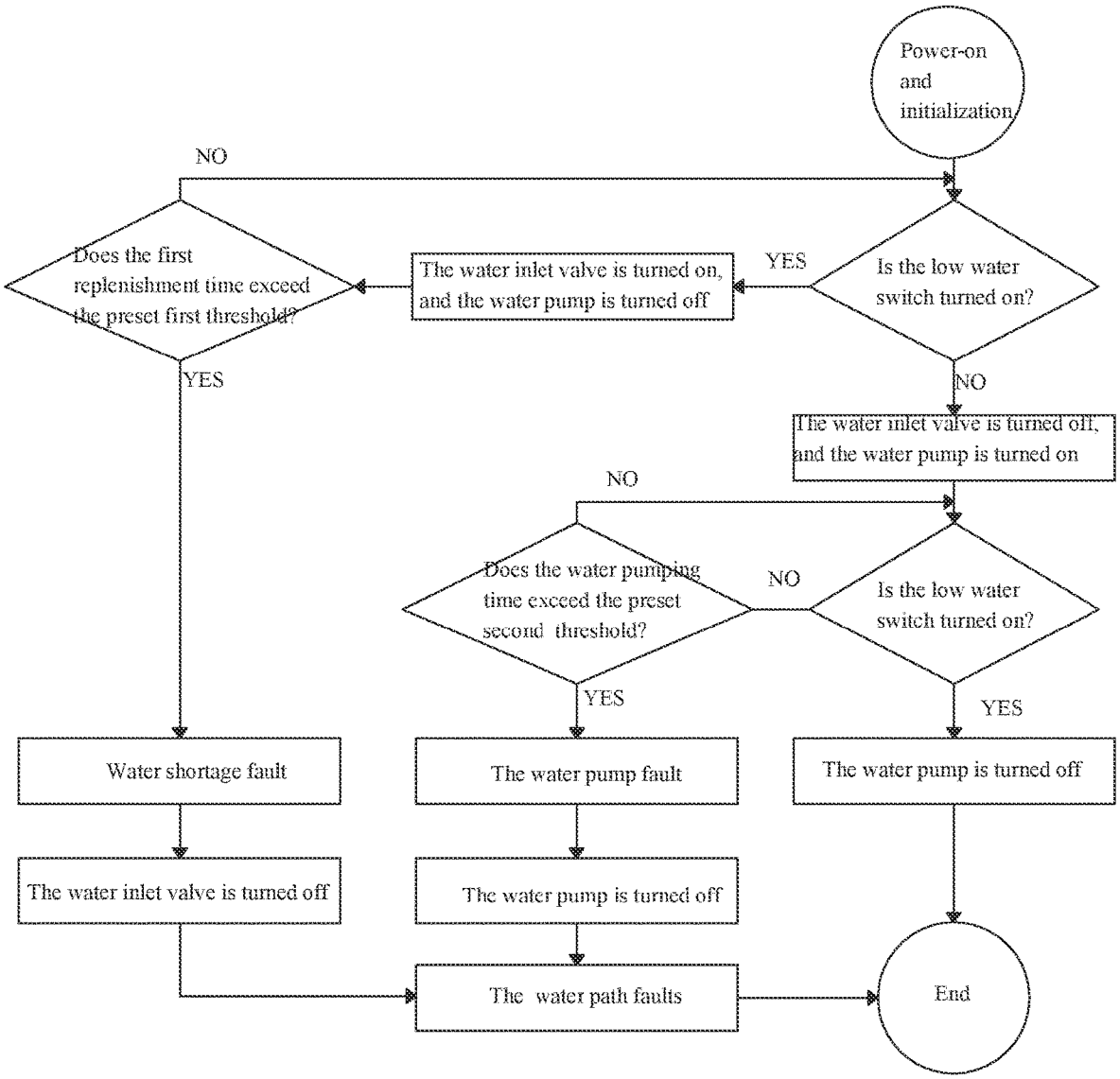
FIG. 4 illustrates a flow chart of a water path self-detection method in the present disclosure.

The present disclosure will be further described below in combination with the accompanying drawings and embodiments.

Referring to FIGS. 1 to 4, a water path self-detection method for a cleaning device is configured to detect a water tank with a heating function, and the cleaning device comprises a water tank 10, a low water level switch 81, a high water level switch 82, a water inlet valve 83, an instant heater box 20, and a water pump 30. The low water level switch 81 and the high water level switch 82 are disposed in the water tank 10, and the water inlet valve 83 is in communication with the water tank 10. The water pump 30 is connected between the water tank 10 and the instant heater box 20, and the water pump 30 is used to pump water in the water tank 10 into the instant heater box 20.

Furthermore, the water tank 10 comprises a water inlet pipe 11 and a water outlet pipe 12. The water inlet pipe 11 is connected to the water inlet valve 83, and the water outlet pipe 12 is connected to the water pump 30. The water inlet valve 83 is controlled by a solenoid valve to enable or disable a flow of water into the water tank 10. The low water level switch 81 and the high water level switch 82 can be disposed at a preset low water level and a preset high water level respectively, which can be realized by using a conventional water level sensor or a magnetic induction switch.

Specifically, taking the magnetic induction switch as an example, a connecting rod 41 and a float 40, or the like, may be disposed in the water tank 10. The connecting rod 41 can be arranged vertically, the float 40 is slidably sleeved outside the connecting rod 41, and the float 40 can be located at a bottom end of the connecting rod 41 under an action of gravity. The magnetic induction switch is disposed on the connecting rod 41 and the float 40. The magnetic induction switch can be set to be a normally open switch. When the float 40 slides relative to the connecting rod 41 under an action of buoyancy and reaches a preset position, the magnetic induction switch is attracted to generate corresponding liquid level information, which is low liquid level information, high level information, etc.

In practical applications, the magnetic induction switch comprises two reed switches and a magnetic component. The two reed switches are disposed in the connecting rod 41, and the magnetic component is disposed in the float 40. The two reed switches are located at the preset high water level and the preset low water level respectively. The magnetic induction switch is not limited to the two reed switches and the magnetic component, and the magnetic induction switch can also be realized by using a micro switch or the like.

The instant heater box 20 can be disposed in the water tank 10 or outside the water tank 10, and a heating chamber 22 and a heater 21 are arranged therein. Water in the heating chamber 22 is heated by the heater 21.

After the cleaning device is powered-on and initialized, the water path self-detection method of the present disclosure comprises the following steps:

1) first judging whether the low water level switch 81 is turned on. When the low water level switch 81 is turned on, controlling the water inlet valve 83 to be turned on, controlling the water pump 30 to be turned off, and going to step 2. When the low water level switch 81 is turned off, controlling the water pump 30 to be turned on, controlling the water inlet valve 83 to be turned off, and going to step 3.

2) Judging whether a water replenishment time exceeds a preset first threshold. When the water replenishment time exceeds the preset first threshold, a water shortage fault is confirmed, and the water inlet valve 83 is controlled to be turned off. When the water replenishment time does not exceed the preset first threshold, returning to step 1. In this step, the water shortage fault is a fault of the water inlet valve 83 or a fault of a water supply to the water tank 10.
3) Judging whether the low water level switch 81 is turned on. When the low water level switch 81 is turned on, a water path is determined to be normal, and the water pump 30 is controlled to be turned off. When the low water level switch 81 is turned off, going to step 4.
4) Judging whether a water pumping time exceeds a preset second threshold. When the water pumping time exceeds the preset second threshold, a water pump fault or an instant heater box water shortage fault is confirmed, and the water pump 30 is controlled to be turned off. When the water pumping time does not exceed the preset second threshold, returning to step 3.

In the method of the present disclosure, in practical applications, a state value of the water path is preset, and an initial value thereof is 0, which means that the water path is normal. When any one of the water shortage fault, the water pump fault, or the instant heater box water shortage fault is detected, the state value of the water path can be set to 1, which represents water path faults.

Figure 5:
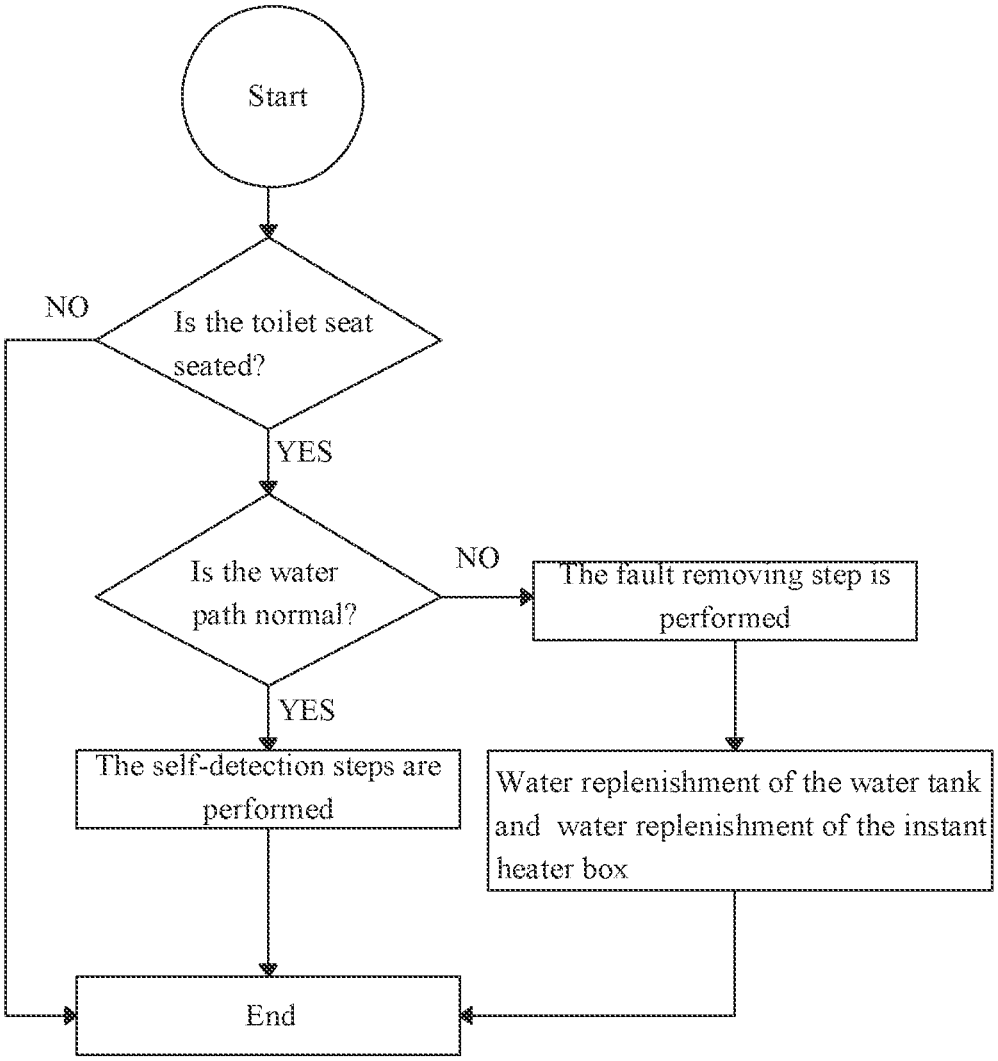
FIG. 5 illustrates a flow chart of a step of removing a fault in the present disclosure.

Referring to FIG. 5, after the self-detection method is complete, when it is detected that a toilet seat is seated, judging whether the water path is normal, that is, whether the status value of the water path is 0. When the status value of the water path is 0, going back to step 1 and continuing to perform the self-detection steps. When the status value of the water path is not 0, performing a fault removing step. The fault removing step comprises performing water replenishment of the water tank 10 first, and then performing water replenishment of the instant heater box 20.

Furthermore, the water replenishment of the water tank 10 comprises water replenishment in a non-flushing mode, during which the water inlet valve 83 is controlled to replenish water when the low water level switch 81 is turned on, and the water replenishment is stopped when the low water level switch 81 is turned off. In the non-flushing mode, when a water inlet time exceeds the preset first threshold and the low water level switch 81 is still turned on, the water replenishment will stop and the water shortage fault is reported. In the non-flushing mode, when the water inlet time exceeds the preset first threshold and the low water level switch 81 is turned off, the water shortage fault is removed.

Furthermore, the water replenishment of the water tank 10 comprises water replenishment in a flushing mode, during which the water inlet valve 83 is controlled to replenish water when the low water level switch 81 is turned on, and the water replenishment is stopped when the high water level switch 82 is turned on. During the water replenishment in the flushing mode, when the water inlet time exceeds a preset third threshold and the low water level switch 81 is still turned on, the water replenishment is stopped and the water shortage fault is reported. During the water replenishment in the flushing mode, when the water inlet time exceeds the preset third threshold and the low water level switch 81 is turned off, the water shortage fault is removed.

In addition, a duty cycle of the water pump 30 in the water replenishment of the instant heater box 20 is the same as a duty cycle of the water pump 30 in step 1, so as to avoid instantaneous overshoot of temperature due to flow changes. Preferably, the duty cycle is 60%. During the water replenishment of the instant heater box 20, it is judged whether the water pumping time exceeds the preset second threshold. When the water pumping time exceeds the preset second threshold, the water pump fault or the instant heater box water shortage fault is confirmed, and the water pump 30 is controlled to be closed.

The disclosure also comprises a step of detecting whether the low water level switch 81 and the high water level switch 82 are faulty. Specifically, the step comprises judging whether the low water level switch 81 and the high water level switch 82 are turned off at the same time. When the low water level switch 81 and the high water level switch 82 are turned off at the same time, a water level switch fault is confirmed, and the water path fault is reported. This step can be performed after the cleaning device is powered-on and initialized, which can be a separate step, can be performed before step 1), or can be performed at other suitable times, and the disclosure is not limited in this regard.

Furthermore, for the water level switch fault, when the fault removing step is performed and when the low water level switch 81 and the high water level switch 82 are not turned on at the same time, the water level switch fault is automatically removed.

In the present disclosure, the preset first threshold, the preset second threshold, and the preset third threshold can be set as required without limitation. Preferably, the preset first threshold and the preset second threshold can be 15 s, and the preset third threshold can be 5 s.

A control device for the water path self-detection method of the present disclosure comprises a controller, which is connected to each of the solenoid valve, the water pump 30, the low water level switch 81, the high water level switch 82, and the heater 21, etc., and the controller is configured to receive signals of the low water level switch 81 and the high water level switch 82 and perform judgments, perform the above-mentioned water path self-detection steps, and control the opening and closing of the solenoid valve and the water pump 30.

The controller of the present disclosure can be applied to a smart toilet. When the cleaning device is powered-on to perform the water path self-detection method, perform the fault removing step, or during normal operation, when one or more of the water path faults are detected, an indicator light (for example, one flash per second) flickers for reminding. When one or more of the water path faults are detected in a cleaning state, the cleaning state is ended, and no cleaning actions, such as rinsing, butt washing, and women's washing, are performed.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A water path self-detection method for a cleaning device, wherein:

the cleaning device comprises a water tank, a low water level switch, a high water level switch, a water inlet valve, an instant heater box, and a water pump, the low water level switch and the high water level switch are disposed in the water tank, the water inlet valve is in communication with the water tank, the water pump is connected between the water tank and the instant heater box, and after the cleaning device is powered-on and initialized, the water path self-detection method comprises the following self-detection steps:

1) judging whether the low water level switch is turned on; when the low water level switch is turned on, controlling the water inlet valve to be turned on, controlling the water pump to be turned off, and going to step 2; and when the low water level switch is turned off, controlling the water pump to be turned on, controlling the water inlet valve to be turned off, and going to step 3;

2) judging whether a water replenishment time exceeds a preset first threshold; when the water replenishment time exceeds the preset first threshold, a water shortage fault is confirmed, and the water inlet valve is controlled to be turned off; and when the water replenishment time does not exceed the preset first threshold, returning to step 1;

3) judging whether the low water level switch is turned on; when the low water level switch is turned on, a water path is normal, and the water pump is controlled to be turned off; and when the low water level switch is turned off, going to step 4; and 4) judging whether a water pumping time exceeds a preset second threshold; when the water pumping time exceeds the preset second threshold, a water pump fault or an instant heater box water shortage fault is confirmed, and the water pump is controlled to be turned off; and when the water pumping time does not exceed the preset second threshold, returning to step 3.

2. The water path self-detection method for the cleaning device according to claim 1, comprising:

after the self-detection steps are complete, judging whether the water path is normal when it is detected that a toilet seat is seated; when the water path is normal, going back to step 1; and when the water path is abnormal, performing a fault removing step.

3. The water path self-detection method for the cleaning device according to claim 2, wherein:

the fault removing step comprises performing water replenishment of the water tank first and then performing water replenishment of the instant heater box.

4. The water path self-detection method for the cleaning device according to claim 3, wherein:

the water replenishment of the water tank comprises water replenishment in a non-flushing mode, and the water replenishment in the non-flushing mode comprises:

controlling the water inlet valve to be turned on for water replenishing when the low water level switch is turned on, and controlling the water inlet valve to be turned off for stopping the water replenishing when the low water level switch is turned off.

5. The water path self-detection method for the cleaning device according to claim 4, wherein:

the water replenishment in the non-flushing mode comprises:

when a water inlet time exceeds the preset first threshold and the low water level switch is still turned on, controlling the water inlet valve to be turned off for stopping the water replenishing and reporting the water shortage fault.

6. The water path self-detection method for the cleaning device according to claim 3, wherein:

the water replenishment of the water tank comprises water replenishment in a flushing mode, and the water replenishment in the flushing mode comprises:

controlling the water inlet valve to be turned on for water replenishing when the low water level switch is turned on, and controlling the water inlet valve to be turned off for stopping the water replenishing when the high water level switch is turned on.

7. The water path self-detection method for the cleaning device according to claim 6, wherein:

the water replenishment in the flushing mode comprises:

when a water inlet time exceeds a preset third threshold and the low water level switch is still turned on:

controlling the water inlet valve to be turned off for stopping the water replenishing, and reporting the water shortage fault.

8. The water path self-detection method for the cleaning device according to claim 3, comprising:

controlling the water pump to perform water pumping at a same duty cycle when the water pump is turned on in the water replenishment of the instant heater box and in step 1.

9. The water path self-detection method for the cleaning device according to claim 1, comprising:

judging whether the low water level switch and the high water level switch are turned off at the same time; when the low water level switch and the high water level switch are turned off at the same time, a water level switch fault is confirmed.

10. A control device for the water path self-detection method for the cleaning device, comprising a controller configured to perform the water path self-detection method according to claim 1.

* * * * *